United States Patent [19]

Matin et al.

[11] Patent Number: 4,845,645

[45] Date of Patent: Jul. 4, 1989

[54] SEQUENTIAL RAPID COMMUNICATION VISUAL DISPLAYS

[75] Inventors: Ethel Matin, Port Washington, N.Y.; Kenneth R. Boff, Dayton, Ohio

[73] Assignee: The United States of America as represented by the Secretary of the Air Force, Washington, D.C.

[21] Appl. No.: 90,500

[22] Filed: Aug. 28, 1987

[51] Int. Cl.[4] ..... G09G 3/02

[52] U.S. Cl. ..... 364/521; 340/716; 434/372

[58] Field of Search ..... 361/518, 521, 522; 340/716, 717, 721; 352/41, 43, 103, 297; 434/338, 350, 362, 372

[56] References Cited

U.S. PATENT DOCUMENTS

| | | | |
|---|---|---|---|
| 3,380,028 | 4/1968 | Gustafson et al. | 340/721 |
| 3,521,228 | 7/1970 | Congleton et al. | 340/721 X |
| 3,537,096 | 10/1970 | Hatfield | 340/716 X |
| 4,149,148 | 4/1979 | Miller et al. | 340/721 |
| 4,247,843 | 1/1981 | Miller et al. | 340/27 NA |
| 4,283,772 | 8/1981 | Johnson | 364/900 |
| 4,467,323 | 8/1984 | Kling et al. | 340/721 |
| 4,543,572 | 9/1985 | Tanaka et al. | 340/723 |
| 4,636,782 | 1/1987 | Nakamura et al. | 340/716 X |

FOREIGN PATENT DOCUMENTS

| | | | |
|---|---|---|---|
| 63059 | 6/1978 | Japan | 340/716 |

*Primary Examiner*—M. H. Paschall
*Assistant Examiner*—A. Jonathan Wysocki
*Attorney, Agent, or Firm*—Bernard E. Franz; Donald J. Singer

[57] ABSTRACT

The rapid communication (RAP-COM) microprocessor controlled memory display system and method operates by presenting real-time data in rapid temporal succession at one spatial location. It can be embodied as a stand-alone instrument or as a small display window within a larger integrated display. It can be incorporated, for example, within larger display configurations in military crew stations, nuclear power plants, air-traffic control centers, space stations, or industrial process control plants. RAP-COM has two advantages over conventional display formats. First, it reduces the amount of required display space be presenting information in sequentially in one location rather than simultaneously in several locations. Second, it speeds the rate of system-to-operator information transfer by eliminating the time needed for the scanning saccadic eye movements that access information from conventional spatially separated displays.

8 Claims, 8 Drawing Sheets

SUBROUTINE 1
START
DRAW RAPOOM SCREENS
DRAW FIXATION SCREEN
RETURN
120
130
131
132

SUBROUTINE 2
START
RPG TIME
DRAW FIXATION SCREEN
RETURN
133
134
135
MAIN PROGRAM
START
SUBROUTINE-1
DISPLAY MESSAGE
DISPLAY OPTION MENU
ENTER RESPONSE
DISPLAY EXIT MESSAGE
STOP
120
121
122
123
124
125
D (SELECT DURATION)
Q (QUIT)
M (MENU)
X
SUB 2
129
128
ENTER RESPONSE
127
DISPLAY FIXATION SCREEN
126

SEQUENTIAL RAPID COMMUNICATION VISUAL DISPLAYS

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The invention relates generally to visual displays, and more particularly to real-time displays of information in environments that include, but are not limited to military crew stations, nuclear power plants, air traffic control centers, and space stations.

In such environments, large amounts of information must be transmitted from the machine to the human operator, with the result that display space is at a premium. In addition, methods for increasing the rate of information transfer are needed. The latter need is particulaly important in time critical application environments such as crew stations in high speed aircraft.

2. Description of Prior Art

The prior art is replete with display instrumentation that provides real-time information for personnel who are responsible for system operation. The displays are fed by signals derived from microprocessor-controlled circuits which sense system parameters and external factors that affect system functioning.

Even at the present time, many otherwise computerized work stations have electromechanical displays of visual information. However, they are rapidly being replaced by computerized displays. The latter enjoy the important advantage of software (computer-program) control over the information that is presented and over display format, thus obviating the need for hardware changes and for re-wiring of circuits when decisions to revise displays are made.

Some computerized visual displays are essentially CRT (cathode ray tube) versions of the earlier electomechanical dials and meters. However, with the rapid growth of the amount of information that must be communicated to the operator, increasingly sophisticated visual displays are being developed. Examples are instruments for providing an integrated display of aircraft flight system parameters on the screen of a single cathode ray tube (U.S. Pat. No. 4,149,148 to Miller et al, 1979, U.S. Pat. No. 4,247,843 to Miller et al, 1981, and U.S. Pat. No. 4,283,705 to James et al, 1981). Other examples of integrated displays are U.S. Pat. No. 4,543,572 to H. Tanaka et al, 1985, which discloses a road map display of the relationship between vehicle position and destination, and U.S. Pat. No. 4,465,323 to M.J. Kling et al, 1984, which discloses an engine analyzer under the control of a microprocessor which sense engine parameters and displays them on a CRT.

For both electro-mechanical and the CRT displays of the prior art, the human operator acquires information from various stand-alone displays and/or from the the subsections of an integrated CRT display by executing a series of scanning eye movements called saccades. Each saccade with the following fixation period takes about 250 msec., including 20–25 msec. of eye travel time. Suprisingly, only 50–60 msec. of the fixation time is needed to acquire most of the information (Rayner, L., Inhoff, A., Morrison, R., Slowiaczek, M., & Bertera, J. (1981). Masking of foveal and parafoveal vision during eye fixations in reading, *Journal of Experimental Psychology: Human Perception and Performance,* 7, 167–179). Rayner et al suggest that the remaining time is sued to program the next eye movement, which then occurs with an oculomotor latency of 125–175 msec.

The scientific findings about eye movements cited in the preceding paragraph suggest that a very considerable time saving could be realized if the operator who is monitoring displaying were relieved of the need for moving the eyes from one display element to the next. Basic research in the psychology of reading with a procedure called rapid serial visual presentation (RSVP) lends support to this idea. With RSVP, the linguistically related individual words of a sentence are presented in rapid sequence to the same spatial location. Experimenters who have used this method to study reading report rate as high as 12 words per second, two to three times the rate usually found when skilled readers scan text with saccadic eye movements. For a review with extensive reference to the RSVP literature, see Potter, M. (1984), Rapid serial visual presentation (RSVP): A method for studying language processing. In D. Kieras & M. Just, (Eds.), *New Methods in Reading Comprehension Research,* New Jersey: Lawrence Erlbaum & Co. Basic research in the psychology of visual search is also relevant. This research shows that search for critical elements (such as a digit among letters) occurs at rates as high as 30 characters per second when eye movements are eliminated by presenting the information sequentially in a single display location. The search rate for similar items presented on an ordinary page is 3–10 characters per second. For a recent review of the search literature, see Chase, W.. (1986), Visual information processing. In K. Boff, L. Kaufman, & J. Thomas, (Eds.), *Handbook of Perception and Human Performance, vol II, Human Cognition and Performance,* New York: Wiley.

SUMMARY OF THE INVENTION

The present invention is a display system for presenting real-time visual information. The invention operates by presenting individual, independent frames of information in rapid temporal succession to one small display window. It is called RAPCOM (Rapid Communication Display Technology).

An object of the invention is to reduce the display space required for machine to operator transfer of real-time information. According to the invention, this is accomplished by presenting N data frames at one spatial location, thereby reducing the required space by a factor of 1/N.

A second object of the invention is to increase the rate of machine to operator information transfer. This object is accomplished in the instant invention by eliminating the time needed for programming and executing the scanning eye movements (saccades) that are used to access information when it is presented in spatially separated display locations.

The invention relates to the sequential presentation of independent frames of real-time visual information in one small display window, in a system in which data points are periodically sensed for data in the form of analog signals, the data is converted to digital form, and then stored and analyzed. Computer software is sued for rapid sequential presentation of the data for display on an electronic image device such as a cathode ray tube as a continually cycling sequence of independent frames of information in a small display window.

The display can be embodied either as a stand-alone device or as a small display window within a larger computerized visual display. The invention can be embodied with and without provision for operator control of speed of frame sequencing. It can exist as a continually cycling display or as a display that is activated at user demand. It can be embodied with provision for user-selection of frame duration or with a pre-selected constant display rate that is not under user control.

DETAILED DESCRIPTION

Two papers to be published by applicants are included with this patent application as filed, and are incorporated as a part of the application.

The invention can be realized physically with a variety of electronic display technologies, including but not limited to CRTs, plasma displays, and electroluminescent displays. Because frame display times as short as 100 msec can produce satisfactory comprehension for some types of information, hardware and software technologies that allow rapid display changes are essential for full exploitation of the device's potential. It can exist as a stand-alone display or as a window within a larger display system.

Figure 1:
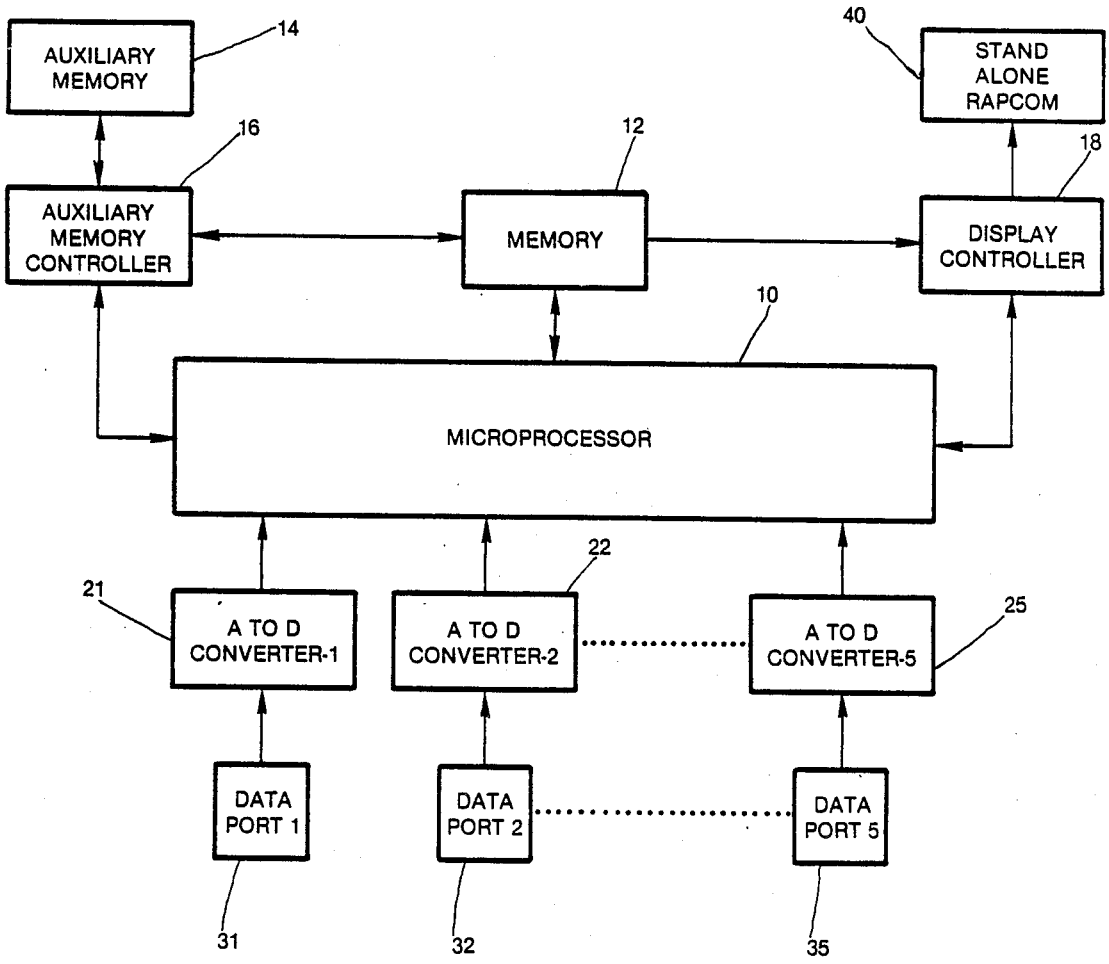
FIGS. 1, 2, 3, and 4 are block diagrams of embodiments of a rapid communication (RAP-COM) display system.
Figure 1A:
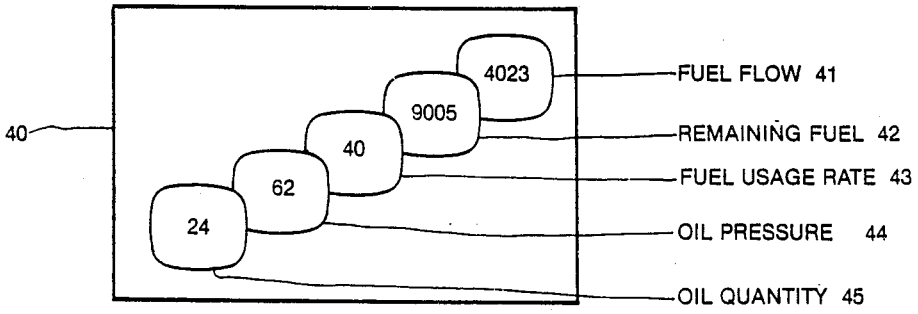
FIG. 1A shows details for the embodiment of FIG. 1.

A block diagram in FIG. 1 shows a possible embodiment of the invention as a stand-alone display of aircraft fuel status. A processor 10 with a main memory 12, and an auxiliary memory 14 is coupled via an auxiliary memory controller 16 to the main memory 12, and also to the processor 10. A RAP-COM window 40 is a stand-alone display, shown in more detail in FIG. 1A. A display controller 18 couples the window unit 40 to the microprocessor 10 and also to the main memory 12. Data acquired from commercially available and commonly known sensing devices enter the computer through five ports 31–35, are digitized by analog to digital converters 21–25, are processed by the processor 10 and the display controller 18, and presented sequentially in the RAP-COM window 40. The FIG. 1A illustration is a more detailed picture of the RAP-COM window 40 of FIG. 1. It shows fuel flow (lbs/hour) 41, remaining fuel (lbs) 42, fuel usage rate (miles/thousand lbs.) 43, oil pressure (lbs/sq. in.) 44 and oil quantity (quarts) 45, which appear in the same display area in sequence, the sequence being continually repeated in cycles.

Figure 2:
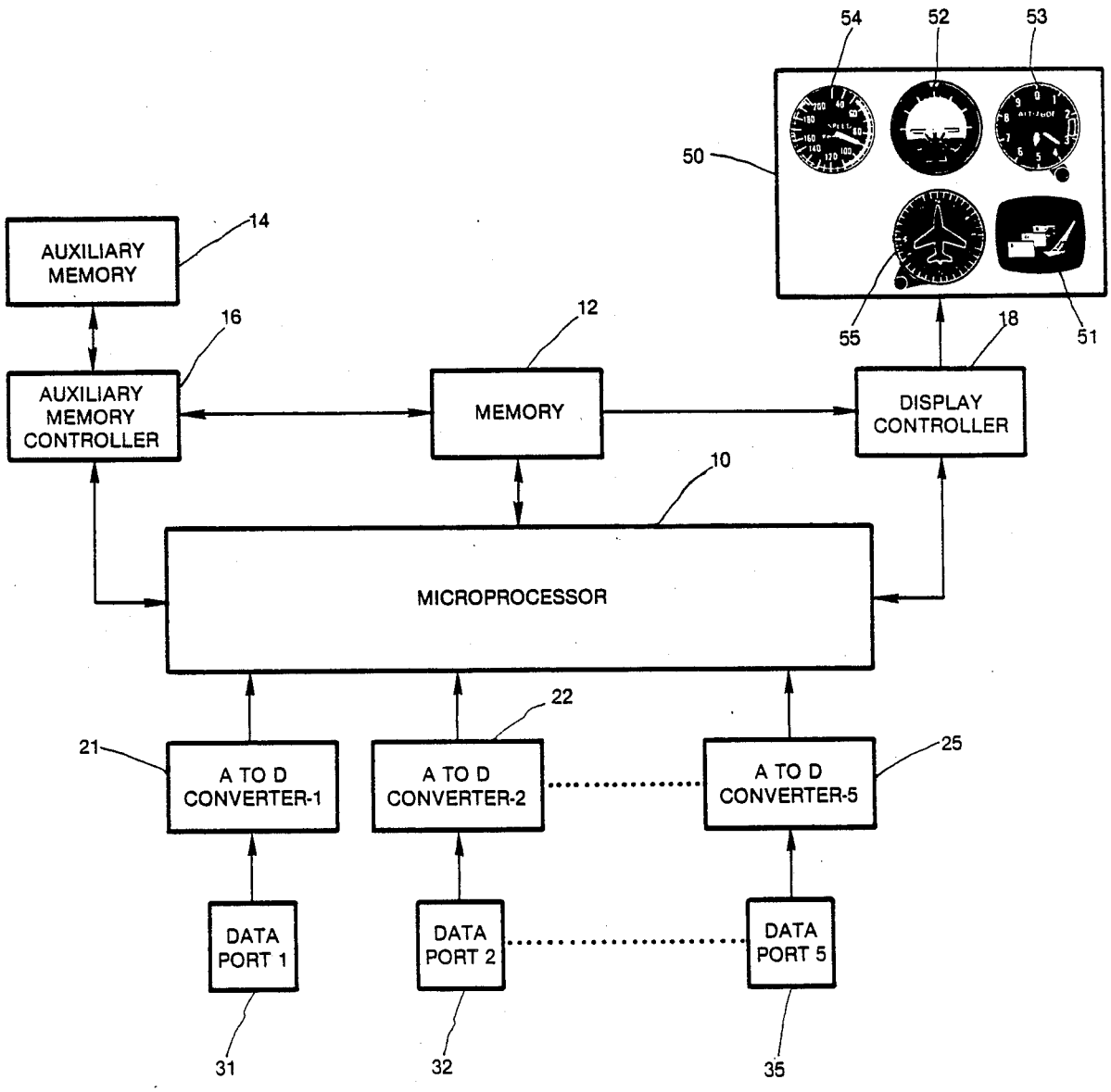

FIG. 2 shows an alternative embodiment of the invention as a RAP-COM window within an integrated display 50. The processor 10, main memory 12, auxiliary memory 14, memory controller 16, analog to digital converters 21–25, and ports 31–35 for data acquisition are similar to those shown in FIG. 1. However the RAPCOM is a window 51 within a larger display 50 which also includes four standard displays (an attitude direction indicator (ADI) 52, an altitude indicator 53, airspeed meter 54 and a heading meter 55), which are well known in the prior art and are not, of course, a part of the instant invention. The RAP-COM window is displaying fuel status information as in FIG. 1A.

Figure 3:
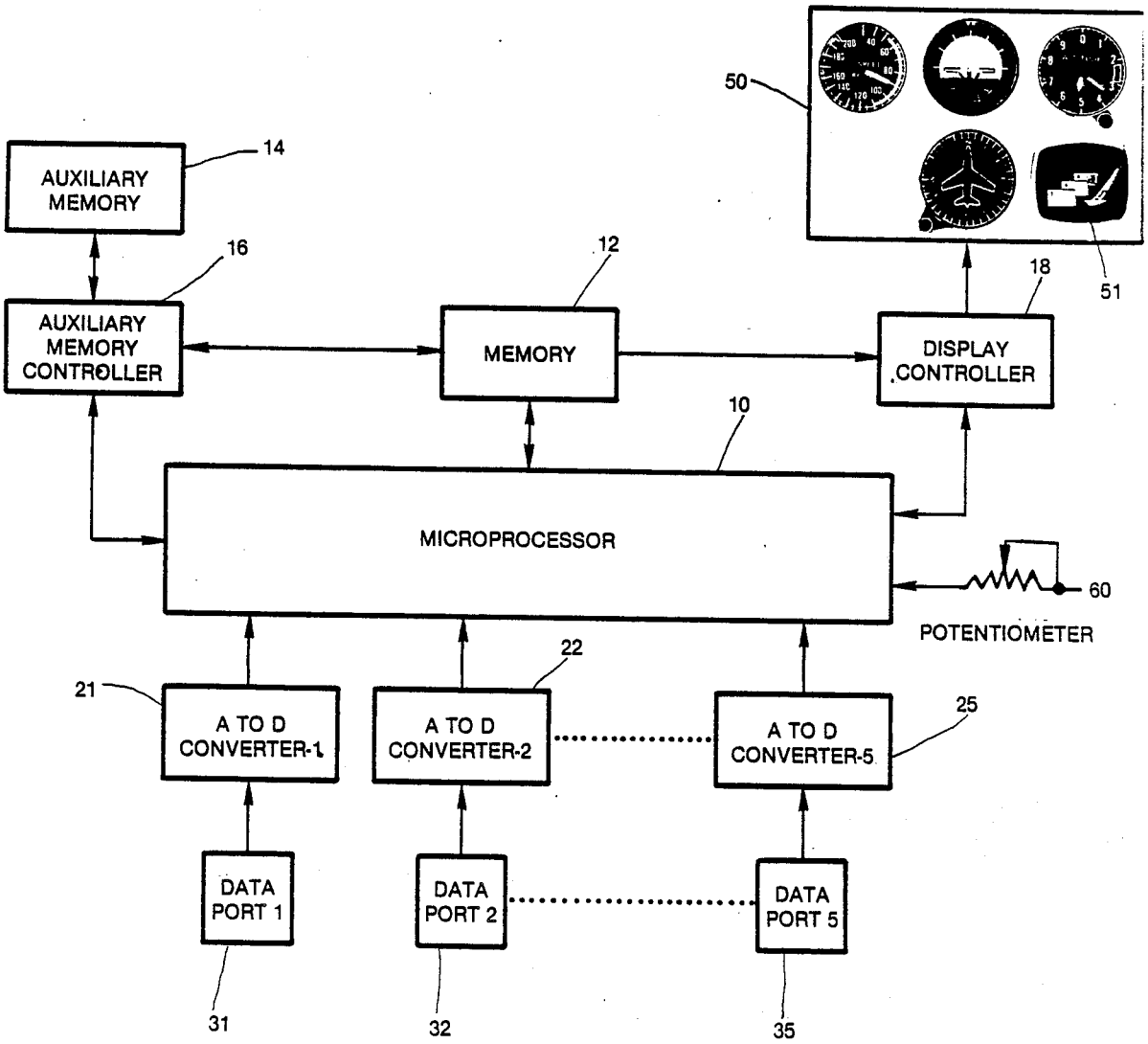

FIG. 3 shows an embodiment of the invention similar to that shown in FIG. 2 with the addition of provision for operator control of rate of RAP-COM frame sequencing, provided by a potentiometer 60.

Figure 4:
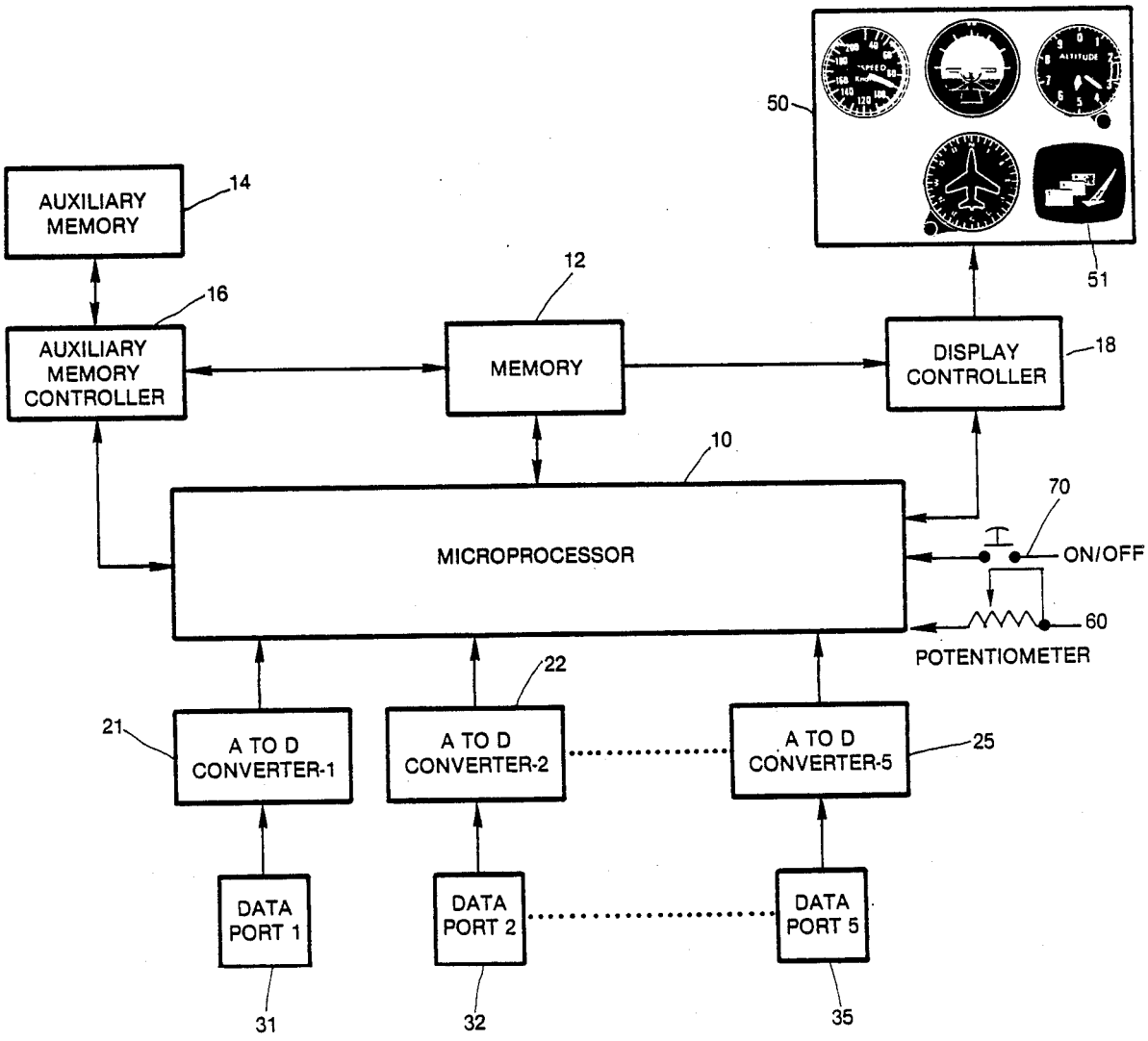

FIG. 4 shows an embodiment of the invention similar to that shown in FIG. 3 with the addition of provision for operator control of display onset and offset by means of an on-off button 70.

Figure 5:
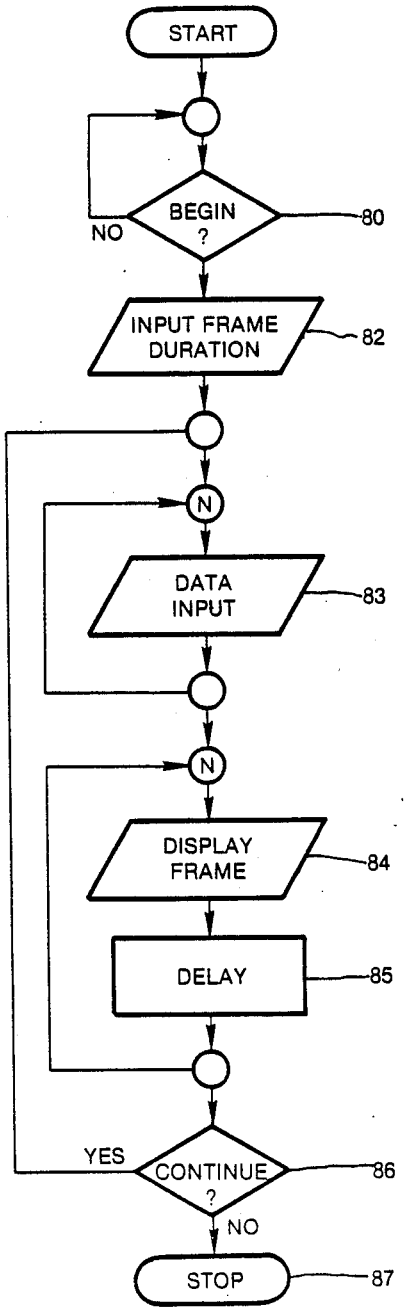
FIGS. 5 is a flow chart for a general embodiment such as that shown in FIG. 4.

FIG. 5 is a flow chart that outlines the RAP-COM display method for the general case where N data items are read into N computer ports and displayed as individual frames in a continually cycling RAP-COM with operator control over frame duration and over display onset and offset. The algorithm provides for operator control of display onset at block 80, and operator selection of the desired frame duration at block 82. The instantaneous values of the N variables enter through the computer's data ports at block 83. They are displayed sequentially at block 84 with a delay at block 85 that corresponds to the frame time selected by the operator at block 82. The algorithm then checks at block 86 to determine whether the operator has requested display offset. The program loops back to a point following block 82 if no offset request is received; otherwise it ends the cycling of the RAP-COM at block 87.

Figures 6, 6A:
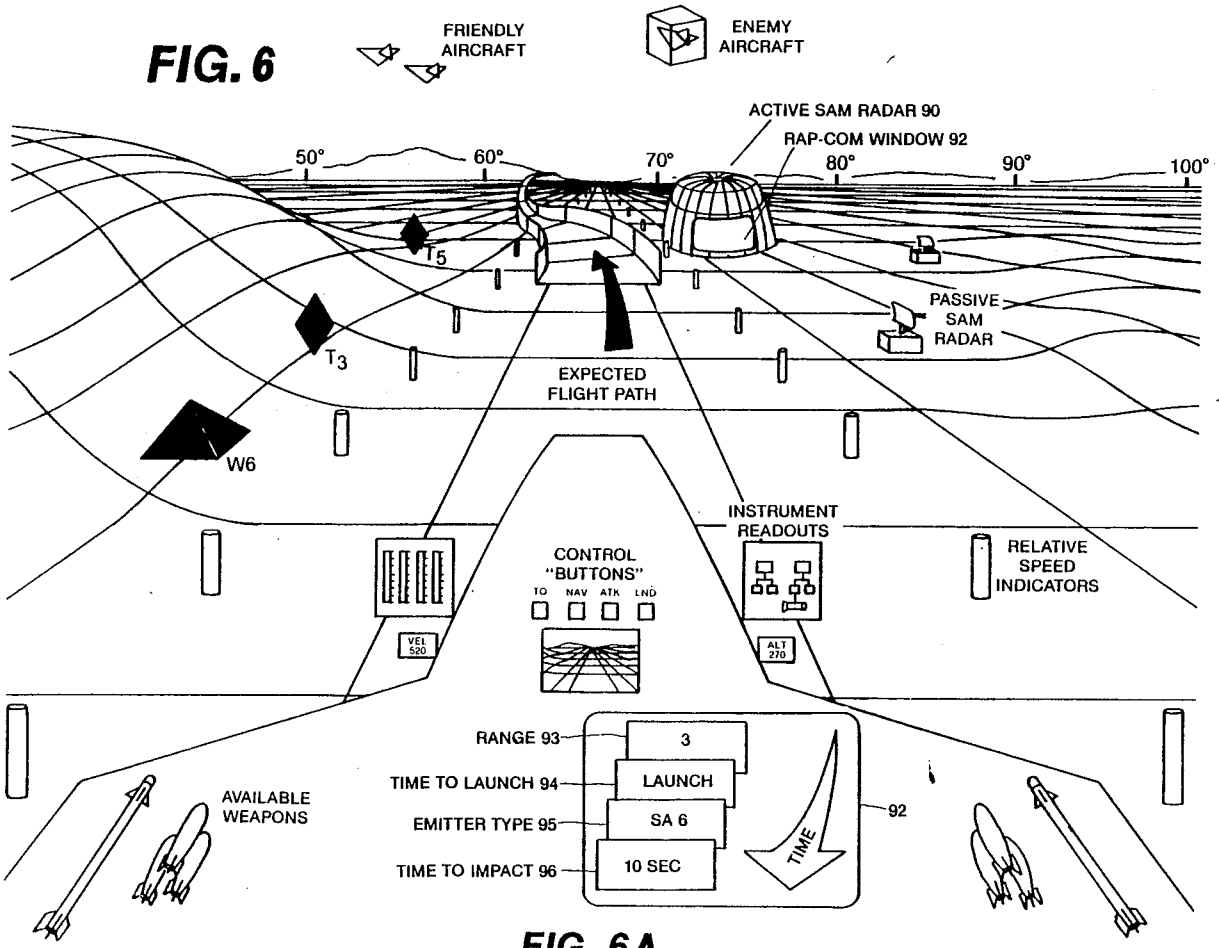
FIG. 6 shows a possible embodiment of RAP-COM as a window within a larger helmet mounted display in a fighter aircraft cockpit.
FIG. 6A shows detail of a display for the embodiment of FIG. 6.

FIG. 6 shows a possible embodiment of RAP-COM in a helmetmounted fighter aircraft display. The RAP-COM window 92 is superimposed over the icon of the active surface-to-air missile radar 90. The FIG. 6A detail shows the current values of 4 items of information about the SAM radar: range of the threat (3 kilometers) 93; mode (launch) 94; emitter type (SA6) 95: and time to impact (10 seconds) 96.

Figure 7:
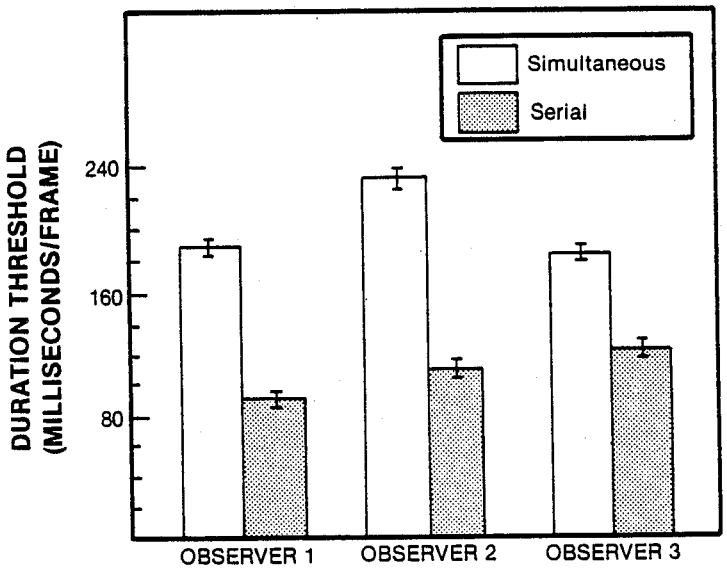
FIG. 7 shows the results of an experimental test of the invention.

FIG. 7 shows the results of an experimental test of the invention. Minimum required information transfer time per frame of information (duration threshold) with a three-frame RAP-COM (serial condition) was compared to a conventional display consisting of three spatially separated windows accessed by saccadic eye movements (simultaneous condition). Expressed as a percentage of time for a conventional simultaneous display, the RAP-COM (serial) display time was 51%, 46%, and 66%, for observers 1, 2 and 3, respectively.

Figures 8, 8A, 8B:
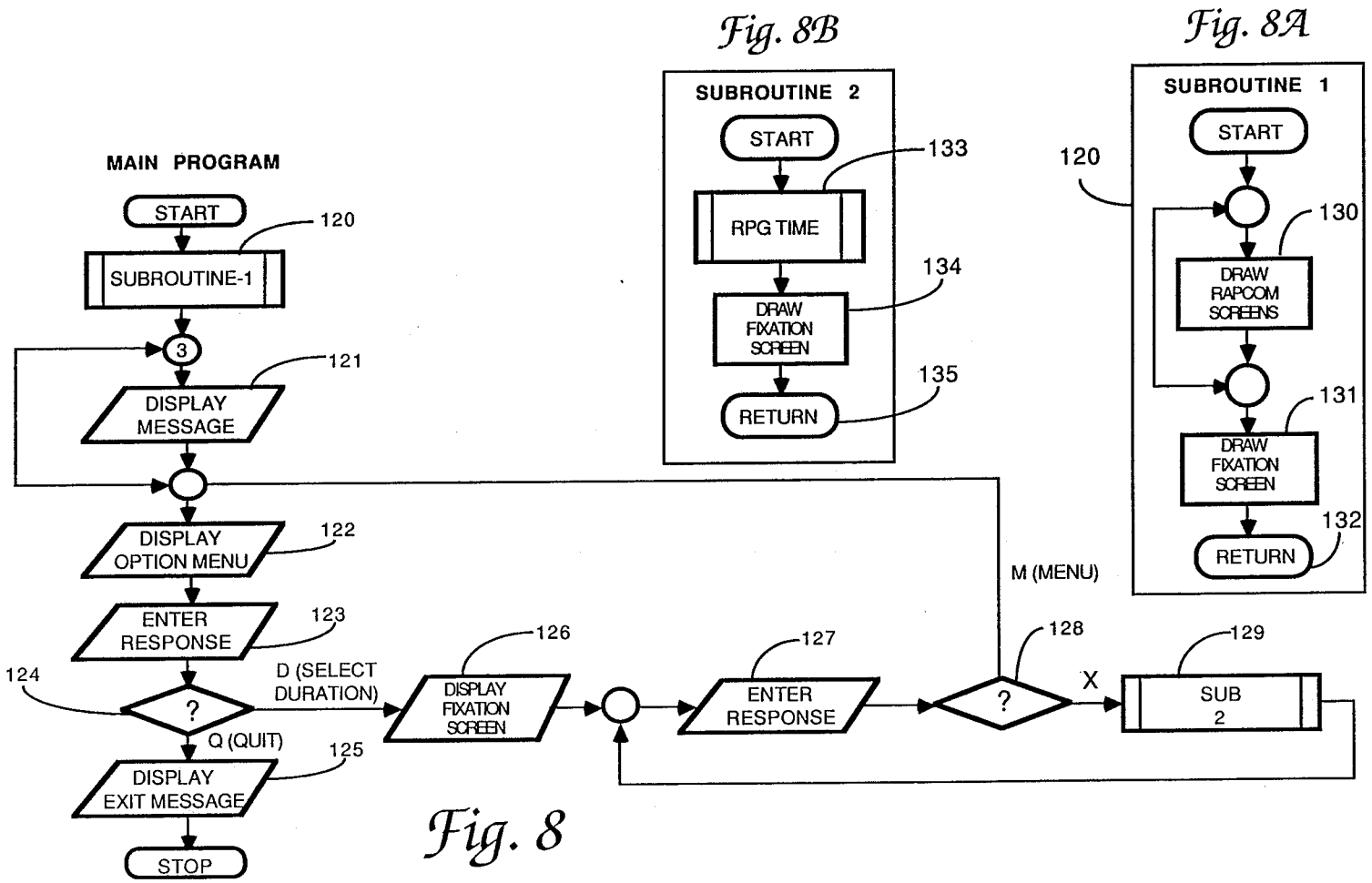
FIG. 8 is a flow chart for an appended computer program that illustrates the RAP-COM display system.

FIG. 8 is a flow chart of a program included with this application as an appendix. This program, RAP-COM.-BAS, which is written in the higher level language BASIC, with an 8088 assembly language routine called RPGTIME.ASM for time critical loops, can be run on an IBM XT microcomputer with IBM enhanced graphics, and IBM 5154 enhanced color display and DOS 3.1 operating system. The purpose of the program is to demonstrate and explain the RAP-COM method in a manner that would allow a skilled practitioner of the art to construct an embodiment of the invention.

The main program branches to Subroutine 1 at block 120 and then displays three messages describing the RAP-COM display at block 121. At block 122, the program presents an option menu which allows the user to quit or to choose a frame duration for viewing a generic RAP-COM with six frames (Note that the values provided in the listing of the appendix at lines 530–555 provide for a frame duration in the range of 100–450 milliseconds. In FIG. 5, block 82 would provide a similar option.) of the program described on page 10 and shown in FIG. 8. The user's response is entered at block 123. At block 124, the computer branches. It displays an exit message at block 125 if the user chooses to exit from the program. Otherwise, it selects the number of raster scans that correspond to the duration chosen by the user and then proceeds to display a fixation frame with another message at block 126. At block 127 the user enters a response to select either a return to the option menu or a viewing of the RAP-COM at the previously chosen duration. Depending on the response, the computer branches at block 128, either looping back to the option menu of moving forward to subroutine 2 (block 129) which displays the six RAP-COM frames. The program then loops back to block 127 to offer the user the choice of returning to the option menu or of viewing the RAP-COM again at the previously selected duration.

BASIC subroutine 1 in the FIG. 8A detail shows the loop 130 that draws six RAP-COM "generic" frames on pages 2 through 7 in the enhanced graphics adapter's display memory (each frame's "data" consists simply of the frame number). A fixation frame which allows the user to fixate on the RAP-COM window prior to requesting the onset of the frame sequence is drawn on page 1 of the display memory at block 131 prior to the return to the main program at block 132. (Note that only one "page" of the display memory appears on the monitor at any one time; the pages are being set up for presentation as a RAP-COM sequence later in the the program).

BASIC subroutine 2 in the FIG. 8B detail calls the assembly language routine RPGTIME at block 133. The latter routine, which is appended to the BASIC program that is being filed with this application, displays the six RAP-COM frames (pages 214 7 of the display memory) for the duration specified by the calling program. At block 134 Subroutine 2 displays the fixation frame (page 1 of the display memory) and returns to the calling program at block 135.

While the invention has been described in various possible embodiments, it is to be understood that the words used were words of description rather than words of limitation and that changes within the purview of the following claims may be made without departing from the true scope and spirit of the invention.

What is claimed is:

1. A display system characterized by the sequential presentation of independent frames of real-time visual information in one small display window, comprising:

means providing said display window on an electronic image display means, the display window being one spatial location which is small enough that it may be viewed in its entirety without scanning eye movements (saccades);

a plurality of data sources, each of which provides digitized data representing the value of information from one data point;

means coupled to the data sources for storing and analyzing the digitized data as a plurality of data items;

means including computer software means for rapid presentation of the data as a continually cycling sequence of independent frames of information in said display window, with the data presented in repetitive cycles, each cycle comprising a frame for each of the data items, and with a representation of the digitized data for each data item being displayed during its individual frame during each cycle.

2. The display system as set forth in claim 1, wherein said display window is embodied as a stand-alone device.

3. The display system as set forth in claim 1, wherein said display window is part of al larger integrated display means.

4. The display system as set forth in claim 14, further including means for permitting operator control of rate of frame sequencing, from options for the frame duration in the range of 100–450 milliseconds.

5. The display system as sets forth in claim 3, further including means for permitting operator control of display onset and offset.

6. The display system as set forth in claim 5, wherein said display window is embodied as a stand-alone device.

7. The display system as set forth in claim 5, wherein said display window is part of a larger integrated display means.

8. A display method characterized by the sequential presentation of independent frames of real-time visual information in one small display window of an electronic image display means, the display window being one spatial location which may be viewed in its entirety without scanning eye movements (saccades), said method comprising the steps:

(a) periodically inputting data from a plurality of data sources, each of which provides digitized data representing the value of information from one data point;

(b) storing and analyzing the digitized data as a plurality of data items;

(c) using computer software to organize the data as a continually cycling rapid sequence of independent frames of information; and (d) displaying the data using computer software for rapid presentation of the data as said continually cycling sequence of independent frames of information in said display window, with the data presented in repetitive cycles, each cycle comprising a frame for each of the data items, and with a representation of the digitized data for each data item being displayed during its individual frame during each cycle.

* * * * *

UNITED STATES PATENT AND TRADEMARK OFFICE

CERTIFICATE OF CORRECTION

PATENT NO. : 4,845,645

DATED : July 4, 1989

INVENTOR(S) : Ethel Matin et al

It is certified that error appears in the above-identified patent and that said Letters Patent is hereby corrected as shown below:

Col 1, line 23, correct the spelling of "particularly".
Col 1, line 25, after "of" insert --the--.
Col 1, line 57, change "sense" to "senses".
Col 1, line 59, after "both" insert --the--.
Col 1, line 61, delete first occurrence of "the".
Col 2, line 5, change "sued" to "used".
Col 2, line 66, change "sued" to "used".
Col 3, line 16, change colon to semicolon ";".
Col 4, line 41, change colon to semicolon ";".
Col 5, lines 5-6, delete "of the program described on page 10 and shown in FIG. 8."
Col 5, line 17, change "of" to "or".
Col 5, line 40, "214 7 should be "2-7".
Col 6, claim 3, line 2, "al" should be "a".
Col 6, claim 4, line 1, "14" should be "1".
Col 6, claim 5, line 1, "sets" should be "set".
Col. 5, line 3, after "lines 530-555" insert --of the program described on page 10 and shown in FIG. 8--.

Signed and Sealed this

Sixteenth Day of October, 1990

*Attest:*

HARRY F. MANBECK, JR.

*Attesting Officer*

*Commissioner of Patents and Trademarks*